US009296459B2

(12) United States Patent
Saruwatari

(10) Patent No.: US 9,296,459 B2
(45) Date of Patent: Mar. 29, 2016

(54) SPACER CASE FOR OUTBOARD MOTOR AND OUTBOARD MOTOR

(71) Applicant: YAMAHA HATSUDOKI KABUSHIKI KAISHA, Iwata-shi, Shizuoka (JP)

(72) Inventor: Kimitaka Saruwatari, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 14/730,373

(22) Filed: Jun. 4, 2015

(65) Prior Publication Data

US 2016/0001867 A1 Jan. 7, 2016

(30) Foreign Application Priority Data

Jul. 1, 2014 (JP) ..... 2014-135662

(51) Int. Cl.
*B63H 20/32* (2006.01)
*B63H 21/36* (2006.01)
*B63H 20/14* (2006.01)

(52) U.S. Cl.
CPC ..... *B63H 20/32* (2013.01); *B63H 20/14* (2013.01)

(58) Field of Classification Search
CPC ..... B63H 20/00; B63H 20/14; B63H 20/32; B63H 2020/00; B63H 2020/14; B63H 2020/32
See application file for complete search history.

(56) References Cited

U.S. PATENT DOCUMENTS 6,814,635 B1 11/2004 Okabe
8,371,885 B2 * 2/2013 Yazaki ..... B63H 20/28 440/76
2004/0014377 A1 * 1/2004 Yasuda ..... B63H 20/32 440/76

FOREIGN PATENT DOCUMENTS

JP 2003-214162 A 7/2003

* cited by examiner

*Primary Examiner* — Daniel V Venne
(74) *Attorney, Agent, or Firm* — Keating & Bennett, LLP

(57) ABSTRACT

In a spacer case for an outboard motor, a rear portion includes an upper fastening hole opening to the upper surface of the spacer case, into which a first fastening member is inserted, and a lower fastening hole opening to the lower surface of the spacer case, into which a second fastening member is inserted. At least one of the upper fastening hole and the lower fastening hole connects to a lateral opening inside the spacer case.

20 Claims, 8 Drawing Sheets

FIG.4 STATE WHERE SPACER CASE HAVING LENGTH L3 IS ARRANGED

FIG.5 STATE WHERE SPACER CASE HAVING LENGTH L4 IS ARRANGED

STATE WHERE NO SPACER CASE IS ARRANGED

MODIFICATION

SPACER CASE FOR OUTBOARD MOTOR AND OUTBOARD MOTOR

CROSS-REFERENCE TO RELATED APPLICATION

This application claims priority to Japanese Patent Application Number JP 2014-135662 filed on Jul. 1, 2014, the entire contents of which are hereby incorporated by reference.

BACKGROUND OF THE INVENTION

1. Field of the Invention

The present invention relates to a spacer case for an outboard motor and an outboard motor, and more particularly, it relates to a spacer case for an outboard motor arranged between an upper case and a lower case and an outboard motor including the spacer case.

2. Description of the Related Art

An outboard motor including a spacer case is known in general. Such an outboard motor including a spacer case is disclosed in Japanese Patent Laid-Open No. 2003-214162, for example.

Japanese Patent Laid-Open No. 2003-214162 discloses an outboard motor including an upper case, a lower case, and a spacer case. The spacer case is arranged between the upper case and the lower case. This spacer case has a function of adjusting the vertical position of the lower case (propeller) with respect to the upper case (the mounting position of the outboard motor on a boat body). In a state where the upper case is positioned above the lower case through the spacer case, studs are inserted from the side of the lower case to the side of the upper case. These studs are longer than the spacer case in a vertical direction. The studs are fastened to the upper case, such that the spacer case is fixed to the upper case as well as to the lower case (is fastened to the upper case together with the lower case).

In the outboard motor described in Japanese Patent Laid-Open No. 2003-214162, however, the length (the length of the spacer case) between the upper case and the lower case varies according to the mounting position of the upper case on the boat body, and hence the studs according to the length of the spacer case must be provided. In other words, in the case where a plurality of spacer cases having different lengths are prepared, a plurality of sets of studs designed according to the lengths of the spacer cases must be prepared, and hence it is difficult to increase the number of various spacer cases. Thus, it is preferable to flexibly accommodate a difference in the length of the spacer case.

In the outboard motor described in Japanese Patent Laid-Open No. 2003-214162, the studs longer than the spacer case must be fastened to the upper case, and hence distortion is easily generated in the studs. Consequently, the fastening power (axial force) of the studs may be reduced due to the distortion of the studs when the spacer case is fixed, particularly in the case where the spacer case is long. Thus, also in the case where spacer cases having various lengths are provided, it is preferable to make it possible to reduce or prevent the reduction in the fastening power (axial force) of the studs and securely fix the spacer case to the upper case and the lower case.

SUMMARY OF THE INVENTION

Preferred embodiments of the present invention have been proposed in order to solve the aforementioned problems, and provide a spacer case for an outboard motor and an outboard motor capable of reducing or preventing a reduction in the fastening power of a fastening member(s) and securely fixing the spacer case to the upper case and/or the lower case while flexibly accommodating a difference in the length of the spacer case in a vertical direction.

A spacer case for an outboard motor according to a first preferred embodiment of the present invention is located between an upper case and a lower case in the outboard motor and configured to adjust the position of the lower case in a vertical direction with respect to the upper case, and includes a front portion including a drive shaft through-hole through which a drive shaft is configured to pass from the upper surface of the spacer case to the lower surface thereof and a rear portion including a lateral opening that opens to a side surface of the spacer case. The rear portion includes an upper fastening hole opening to the upper surface of the spacer case, into which a first fastening member is configured to be received and a lower fastening hole opening to the lower surface of the spacer case, into which a second fastening member is configured to be received, and at least one of the upper fastening hole and the lower fastening hole connects to the lateral opening inside the spacer case.

In the spacer case according to a preferred embodiment of the present invention, as described above, the upper fastening hole opening to the upper surface of the spacer case, into which the first fastening member is configured to be received and the lower fastening hole opening to the lower surface of the spacer case, into which the second fastening member is configured to be received, are provided in the rear portion, and at least one of the upper fastening hole and the lower fastening hole connects to the lateral opening inside the spacer case. Thus, even in the case where the length (the length of the spacer case) between the upper case and the lower case is varied according to the mounting position of the upper case on a boat body, the fastening member (the first fastening member, the second fastening member) is inserted into at least one of the upper fastening hole and the lower fastening hole through the lateral opening of the spacer case to fix the spacer case. Consequently, the length of the fastening hole connecting to the lateral opening is kept constant even in the case where spacer cases having different lengths are prepared, and hence no fastening member having a length according to the length of each of the spacer case is necessary. Thus, the length of the spacer case is capable of being varied without increasing the type of fastening members, and hence preferred embodiments of the present invention flexibly accommodate a difference in the length of the spacer case.

When the spacer case is fixed to the upper case and the lower case, the fastening member (the first fastening member, the second fastening member) is inserted into at least one of the upper fastening hole and the lower fastening hole through the lateral opening to fix the spacer case, and hence the spacer case is fastened to the upper case and/or the lower case by the fastening member(s) shorter than the spacer case. Thus, distortion of the fastening member(s) is significantly reduced or prevented. Therefore, a reduction in the fastening power of the fastening member(s) is reduced or prevented, and the spacer case is securely fixed to the upper case and/or the lower case.

Thus, in the spacer case according to a preferred embodiment of the present invention, the reduction in the fastening power of the fastening member(s) is reduced or prevented, and the spacer case is securely fixed to the upper case and/or the lower case while flexibly accommodating a difference in the length of the spacer case in the vertical direction.

Furthermore, in the case where the upper fastening hole connects to the lateral opening inside the spacer case, the spacer case is fixed to the upper case by the first fastening member inserted into the upper fastening hole through the lateral opening. Therefore, the first fastening member is inserted from the lower side of the upper case, and hence external water is prevented from accumulating in an insertion opening for the first fastening member of the upper case.

In the spacer case according to a preferred embodiment of the present invention, the lateral opening is preferably a lateral through-hole laterally passing through the spacer case, or a lateral recessed portion opening to the side surface of the spacer case. According to this structure, in the case where the lateral opening is the lateral through-hole, the opening shape is bilaterally symmetrical. In the case where the lateral opening is the lateral recessed portion, only a minimal open portion of the side surface is necessary to insert the first fastening member or the second fastening member.

In the spacer case according to a preferred embodiment of the present invention, the lateral opening preferably includes a cover member covering the lateral opening. According to this structure, an increase in resistance between the spacer case and external water is prevented even in the case where the lateral opening is provided. Furthermore, entry of extraneous material into the spacer case through the lateral opening is reduced or prevented.

In the spacer case according to a preferred embodiment of the present invention, one of the upper fastening hole and the lower fastening hole preferably includes a female screw hole. According to this structure, the first fastening member or the second fastening member inserted from one of the upper case and the lower case is easily fastened to one of the upper fastening hole and the lower fastening hole of the spacer case.

In this case, the female screw hole is preferably not provided in the upper fastening hole but is preferably provided in the lower fastening hole, the upper fastening hole preferably connects to the lateral opening, and the rear portion is preferably fastened to the upper case by the first fastening member being inserted upward from the lateral opening into the upper fastening hole, and is preferably fastened to the lower case by the second fastening member being inserted from the lower case toward the lateral opening into the female screw hole of the lower fastening hole. According to this structure, the first fastening member inserted from the lower side of the upper fastening hole (the lower side of the outboard motor), penetrating to the upper case is easily fastened to a female screw hole of the upper case, and the second fastening member inserted from the lower side of the lower case (the lower side of the outboard motor) is easily fastened to (the female screw hole of) the lower fastening hole.

In the structure in which the female screw hole is not provided in the upper fastening hole, the lateral opening is preferably provided in an upper portion of the side surface of the spacer case. According to this structure, the length of the upper fastening hole connecting to the lateral opening inside the spacer case is further reduced, and hence the length of the first fastening member inserted upward from the upper fastening hole through the lateral opening is further reduced.

In the spacer case according to a preferred embodiment of the present invention, a plurality of upper fastening holes and a plurality of lower fastening holes are preferably provided along an anteroposterior direction of the spacer case. According to this structure, the spacer case is more reliably fixed to the upper case and the lower case by a plurality of first fastening members and a plurality of second fastening members.

In the spacer case according to a preferred embodiment of the present invention, the upper fastening hole is preferably provided at a position corresponding to the lower fastening hole in the vertical direction. According to this structure, a fastening hole of the upper case into which the first fastening member is inserted into the upper fastening hole of the spacer case and a fastening hole of the lower case into which the second fastening member is inserted into the lower fastening hole of the spacer case are arranged at positions corresponding to each other. Thus, even in the case where no spacer case is arranged between the upper case and the lower case, the upper case and the lower case are directly fixed to each other by the fastening hole of the upper case and the fastening hole of the lower case.

In the spacer case according to a preferred embodiment of the present invention, the upper fastening hole and the lower fastening hole are preferably provided in the vicinity of a centerline of the spacer case extending in an anteroposterior direction in a plan view. According to this structure, the spacer case and the upper case are fixed in a balanced manner in the vicinity of the centerline of the spacer case while the spacer case and the lower case are fixed in a balanced manner in the vicinity of the centerline of the spacer case.

In the above structure in which the upper fastening hole and the lower fastening hole are provided in the vicinity of the centerline of the spacer case in the plan view, the lateral opening is preferably a lateral recessed portion recessed from the side surface toward the centerline of the spacer case, and the lateral recessed portion is preferably recessed from one of side surfaces of the spacer case beyond the centerline in the plan view. According to this structure, the first fastening member and the second fastening member are easily inserted into the upper fastening hole and the lower fastening hole provided in the vicinity of the centerline of the spacer case. Consequently, the spacer case is easily fixed to the upper case and the lower case without providing a lateral through-hole.

In the spacer case according to a preferred embodiment of the present invention, the lateral opening preferably has a rectangular or substantially rectangular shape. According to this structure, an insertion operation is more easily performed when the plurality of fastening members are inserted through the lateral opening along the anteroposterior direction, for example, unlike the case where the lateral opening has a circular shape.

An outboard motor according to a second preferred embodiment of the present invention includes an engine, a drive shaft configured to be driven by the engine, an upper case through which the drive shaft passes, a lower case arranged below the upper case, and a spacer case arranged between the upper case and the lower case and configured to adjust the position of the lower case in a vertical direction with respect to the upper case, and the spacer case includes a front portion including a drive shaft through-hole through which the drive shaft passes from the upper surface of the spacer case to the lower surface of the spacer case and a rear portion including a lateral opening that opens to a side surface of the spacer case. The rear portion includes an upper fastening hole opening to the upper surface of the spacer case, into which a first fastening member is inserted, and a lower fastening hole opening to the lower surface of the spacer case, into which a second fastening member is inserted, and at least one of the upper fastening hole and the lower fastening hole connects to the lateral opening inside the spacer case.

In the outboard motor according to the second preferred embodiment of the present invention, the upper fastening hole opening to the upper surface of the spacer case, into which the first fastening member is inserted, and the lower fastening hole opening to the lower surface of the spacer case, into which the second fastening member is inserted, are provided in the rear portion, and at least one of the upper fastening hole and the lower fastening hole connects to the lateral opening inside the spacer case. Thus, the outboard motor including the spacer case flexibly accommodates a difference in the length of the spacer case. Furthermore, a reduction in the fastening power of the fastening members is reduced or prevented, and the spacer case of the outboard motor is securely fixed to the upper case and the lower case. Consequently, a reduction in the stiffness of all the cases of the outboard motor is reduced or prevented even in the case, where in addition to the upper case and the lower case, the spacer case is provided. Thus, in the outboard motor according to the second preferred embodiment of the present invention, the reduction in the fastening power of the fastening members is reduced or prevented, and the spacer case is securely fixed to the upper case and the lower case while the outboard motor flexibly accommodates a difference in the length of the spacer case in the vertical direction.

In addition, in the case where the upper fastening hole connects to the lateral opening inside the spacer case, the spacer case is fixed from the lower side of the upper case by the first fastening member inserted into the upper fastening hole through the lateral opening.

In the outboard motor according to the second preferred embodiment of the present invention, the first fastening member and the second fastening member each preferably have a length not more than the length of the spacer case in the vertical direction. According to this structure, the first fastening member and the second fastening member are shorter than the spacer case, such that distortion of the first fastening member and the second fastening member is reduced or prevented.

In this case, at least one of the first fastening member and the second fastening member, inserted into the upper fastening hole or the lower fastening hole through the lateral opening, preferably has the length not more than the length of the lateral opening in the vertical direction. According to this structure, at least one of the first fastening member and the second fastening member is easily inserted into the upper fastening hole or the lower fastening hole through the lateral opening. Consequently, a fastening operation using the fastening member(s) is easily performed.

In the outboard motor according to the second preferred embodiment of the present invention, the lateral opening is preferably mounted with a cover member covering the lateral opening. According to this structure, an increase in resistance between the spacer case and external water is prevented even in the case where the lateral opening is provided. Furthermore, entry of extraneous material into the spacer case through the lateral opening is prevented.

In the outboard motor according to the second preferred embodiment of the present invention, one of the upper fastening hole and the lower fastening hole preferably includes a female screw hole. According to this structure, the first fastening member or the second fastening member inserted from one of the upper case and the lower case is easily fastened to one of the upper fastening hole and the lower fastening hole of the spacer case.

In this case, the female screw hole is preferably not provided in the upper fastening hole but is preferably provided in the lower fastening hole, the upper fastening hole preferably connects to the lateral opening, and the rear portion is preferably fastened to the upper case by the first fastening member being inserted upward from the lateral opening into the upper fastening hole, and is preferably fastened to the lower case by the second fastening member being inserted from the lower case toward the lateral opening into the female screw hole of the lower fastening hole. According to this structure, the first fastening member inserted from the lower side of the upper fastening hole (the lower side of the outboard motor), penetrating to the upper case is easily fastened to a female screw hole of the upper case, and the second fastening member inserted from the lower side of the lower case (the lower side of the outboard motor) is easily fastened to (the female screw hole of) the lower fastening hole.

In the structure in which the female screw is not provided in the upper fastening hole, the lateral opening is preferably provided in an upper portion of the side surface of the spacer case. According to this structure, the length of the upper fastening hole connecting to the lateral opening inside the spacer case is further reduced, and hence the length of the first fastening member inserted upward from the upper fastening hole through the lateral opening is further reduced.

In the outboard motor according to the second preferred embodiment of the present invention, a plurality of upper fastening holes and a plurality of lower fastening holes are preferably arranged along an anteroposterior direction. According to this structure, the spacer case is reliably fixed to the upper case and the lower case by a plurality of first fastening members and a plurality of second fastening members.

In the outboard motor according to the second preferred embodiment of the present invention, the upper fastening hole is preferably provided at a position corresponding to the lower fastening hole in the vertical direction. According to this structure, a fastening hole of the upper case, into which the first fastening member is inserted into the upper fastening hole of the spacer case, and a fastening hole of the lower case, into which the second fastening member is inserted into the lower fastening hole of the spacer case, are arranged at positions corresponding to each other. Thus, even in the case where no spacer case is arranged between the upper case and the lower case, the upper case and the lower case are directly fixed to each other by the fastening hole of the upper case and the fastening hole of the lower case.

According to the preferred embodiments of the present invention, the reduction in the fastening power of the fastening member(s) is reduced or prevented, and the spacer case is securely fixed to the upper case and/or the lower case while the outboard motor flexibly accommodates a difference in the length of the spacer case in the vertical direction.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of an outboard motor 1 according to a preferred embodiment of the present invention is now described with reference to FIGS. 1 to 6. In the figures, arrow FWD represents the forward movement direction of a boat body, and arrow BWD represents the reverse movement direction of the boat body.

Figure 1:
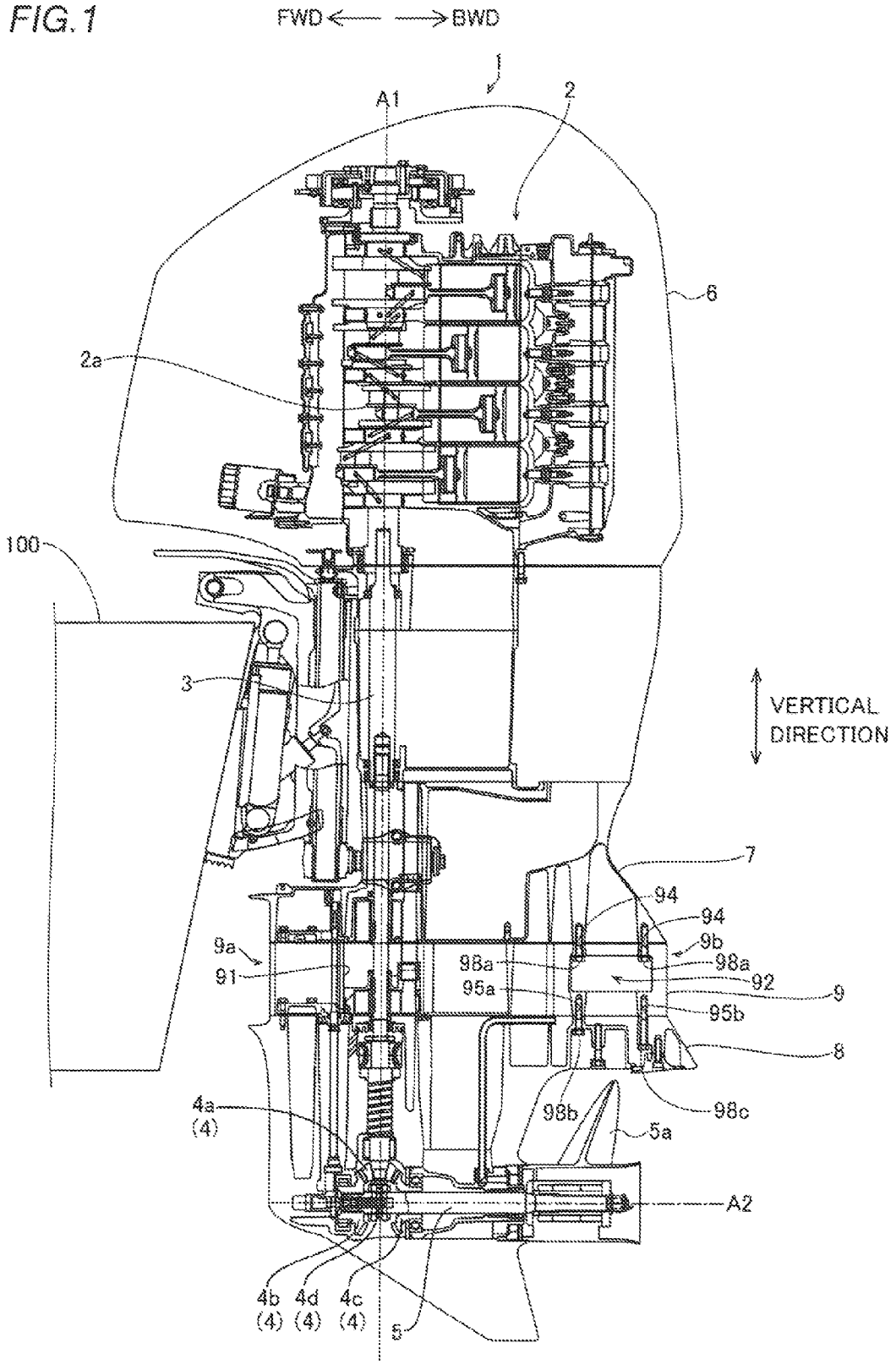
FIG. 1 is a diagram illustrating the overall structure of an outboard motor according to a preferred embodiment of the present invention.

The outboard motor 1 includes an engine 2, a drive shaft 3, a bevel gear 4, and a propeller shaft 5, as shown in FIG. 1. The outboard motor 1 also includes a cowling (engine case) 6, an upper case 7, a lower case 8, and a spacer case 9. The spacer case 9 is an example of the "spacer case for an outboard motor" according to a preferred embodiment of the present invention.

The engine 2 includes a crank shaft 2*a*. The engine 2 is driven to rotate the crank shaft 2*a*.

The crank shaft 2*a* is configured to rotate about a rotation axis line A1 extending in a vertical direction. A lower end of the crank shaft 2*a* is connected to an upper end of the drive shaft 3.

The drive shaft 3 is configured to rotate about the rotation axis line A1. The drive shaft 3 is configured such that the drive force of the engine 2 is transmitted thereto through the crank shaft 2*a*. Thus, the drive shaft 3 rotates about the rotation axis line A1 coaxially with the crank shaft 2*a*.

The bevel gear 4 includes a pinion gear 4*a* mounted on a lower end of the drive shaft 3 and a forward movement bevel gear 4*b* and a reverse movement bevel gear 4*c* to transmit power to the propeller shaft 5.

The propeller shaft 5 is configured to extend in a direction orthogonal to the drive shaft 3. A propeller 5*a* is mounted on a rear end of the propeller shaft 5. The pinion gear 4*a* mounted on the lower end of the drive shaft 3 engages with the forward movement bevel gear 4*b* and the reverse movement bevel gear 4*c*, and the forward movement bevel gear 4*b* and the reverse movement bevel gear 4*c* are selectively coupled to a dog clutch 4*d* rotating integrally with the propeller shaft 5, such that the propeller shaft 5 rotates about an axis line A2.

The cowling 6 is configured to cover the engine 2. The cowling 6 is preferably made of resin or metal, for example.

Figure 2:
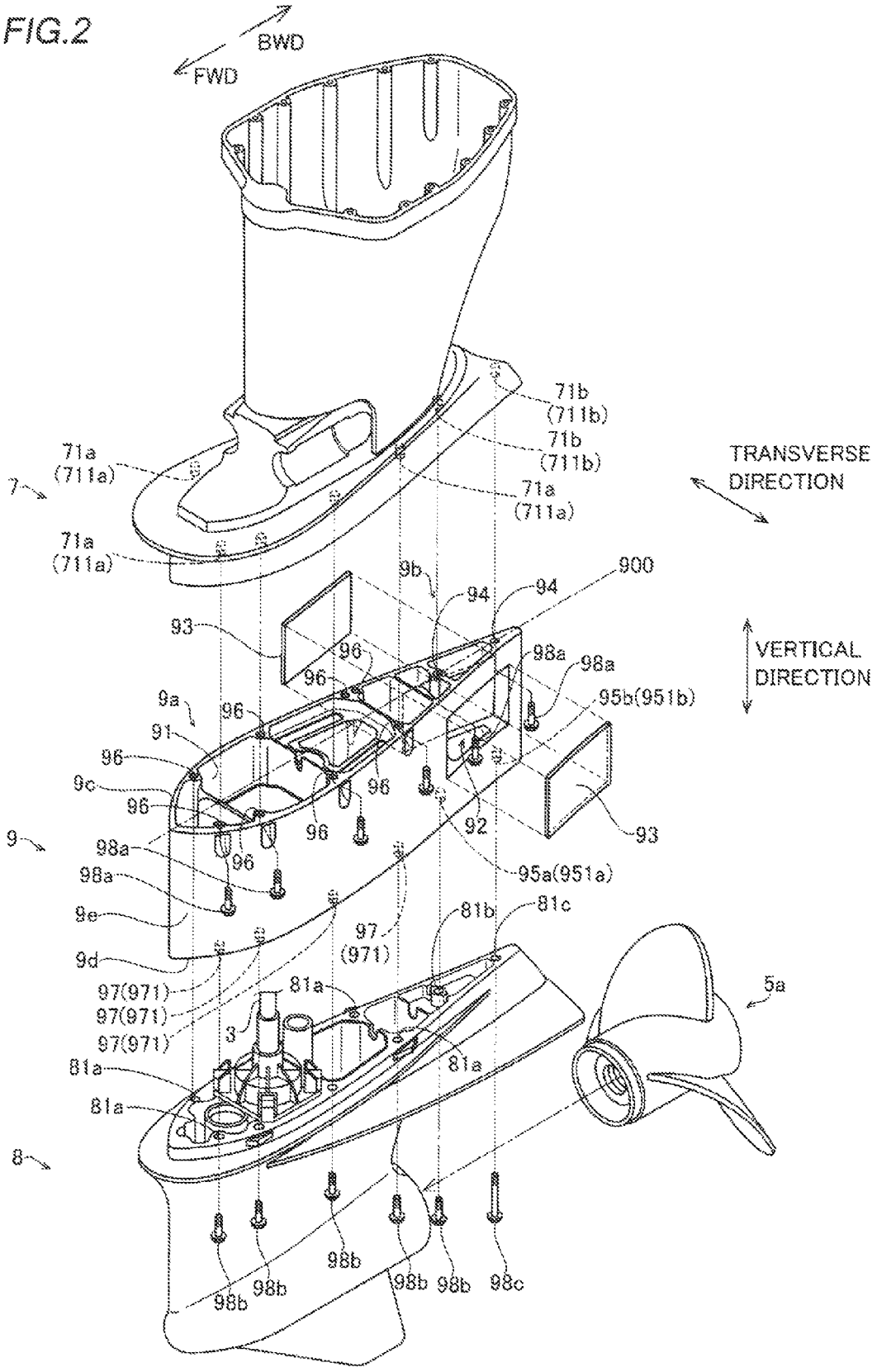
FIG. 2 is an exploded perspective view showing an upper case, a lower case, and a spacer case of the outboard motor according to a preferred embodiment of the present invention.

The upper case 7 is arranged below the engine 2 and the cowling 6. The upper case 7 is configured such that the drive shaft 3 passes therethrough. As shown in FIG. 2, a lower end of the upper case 7 includes screw holes 71*a* and 71*b* into which bolts 98*a* described below are inserted. A plurality of screw holes 71*a* are arranged in the vicinity of an outer edge of the upper case 7 in a plan view. Two screw holes 71*b* are located in a rear portion of the upper case 7 in the plan view. These screw holes 71*b* are arranged in a central or substantially central portion of the upper case 7 in a transverse direction perpendicular to a anteroposterior direction in the plan view. The inner peripheral surfaces of the screw holes 71*a* and 71*b* include female screw threads 711*a* and 711*b*, respectively. The bolts 98*a* are examples of a "first fastening member" according to a preferred embodiment of the present invention.

As shown in FIG. 1, the lower case 8 is arranged below the upper case 7. The lower case 8 is configured to cover a lower portion of the drive shaft 3, the pinion gear 4*a*, the forward movement bevel gear 4*b*, the reverse movement bevel gear 4*c*, and the propeller shaft 5. As shown in FIG. 2, an upper end of the lower case 8 includes screw insertion holes 81*a* and 81*b* into which bolts 98*b* described below are inserted and a screw insertion hole 81*c* into which a bolt 98*c* described below is inserted. A plurality of screw insertion holes 81*a* are arranged in the vicinity of an outer edge of the lower case 8 in the plan view. One screw insertion hole 81*b* and one screw insertion hole 81*c* are arranged in a rear portion of the lower case 8 in the plan view. The screw insertion holes 81*b* and 81*c* are arranged in a central or substantially central portion of the lower case 8 in the transverse direction perpendicular to the anteroposterior direction in the plan view. No female screw holes are arranged on the inner peripheral surfaces of the screw insertion holes 81*a* to 81*c*. The bolts 98*b* are examples of a "second fastening member" according to a preferred embodiment of the present invention. The bolt 98*c* is also an example of a "second fastening member" according to a preferred embodiment of the present invention.

As shown in FIG. 1, the spacer case 9 is arranged between the upper case 7 and the lower case 8. The spacer case 9 is configured to adjust the position of the lower case 8 (propeller 5*a*) in the vertical direction with respect to the upper case 7 (the mounting position of the outboard motor on a boat body 100). The spacer case 9 includes a front portion 9*a* in the forward movement direction of the boat body 100 and a rear portion 9*b* in the reverse movement direction of the boat body 100. As shown in FIG. 2, the spacer case 9 is configured such that an upper end and a lower end thereof are parallel or substantially parallel to each other. The spacer case 9 is tapered from the front side to the rear side and has a streamline shape in the plan view. The spacer case 9 is preferably made of metal such as aluminum, for example.

The front portion 9*a* includes a drive shaft through-hole 91 through which the drive shaft 3 passes from the upper surface 9*c* of the spacer case 9 to the lower surface 9*d* thereof.

Figure 3:
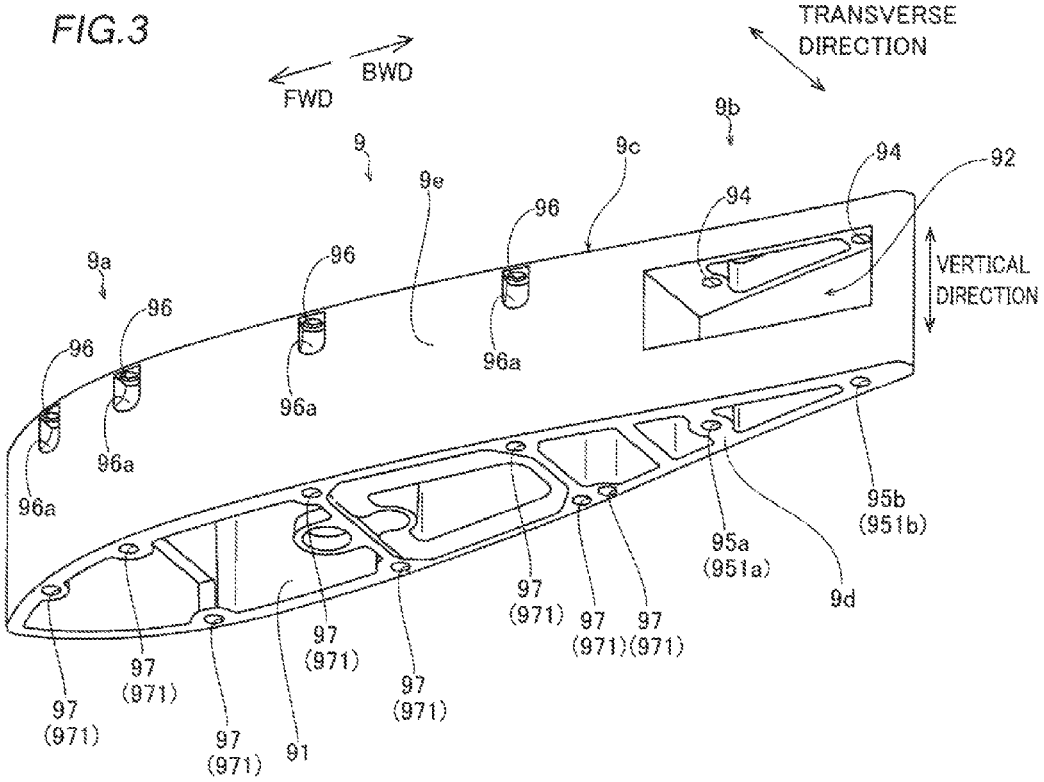
FIG. 3 is a perspective view of the spacer case of the outboard motor according to a preferred embodiment of the present invention, as viewed from below.

The rear portion 9*b* includes a lateral through-hole 92 opening to side surfaces 9*e* of the spacer case 9 and cover members 93. As shown in FIGS. 2 and 3, the rear portion 9*b* includes upper fastening holes 94 and lower fastening holes 95*a* and 95*b*. An outer peripheral portion of the upper surface 9*c* of the spacer case 9 is provided with lateral fastening holes 96. An outer peripheral portion of the lower surface 9*d* of the spacer case 9 is provided with lateral fastening holes 97. The spacer case 9 and the upper case 7 are fixed by the bolts 98*a*. The spacer case 9 and the lower case 8 are fixed by the bolts 98*b* and 98*c*. The lateral through-hole 92 is an example of a "lateral opening" according to a preferred embodiment of the present invention.

As shown in FIG. 2, the lateral through-hole 92 is provided in upper portions (in the vicinity of the upper surface 9*c*) of the side surfaces 9*e* of the spacer case 9. The lateral through-hole 92 passes through the spacer case 9 laterally. As shown in FIGS. 1 and 2, the lateral through-hole 92 preferably has a rectangular or substantially rectangular shape, as viewed from a lateral side. More specifically, the lateral through-hole 92 has a rectangular or substantially rectangular shape including longer sides in the anteroposterior direction.

A pair of cover members 93 (see FIG. 2) cover the lateral through-hole 92 from both sides. The cover members 93 are preferably made of resin, for example. The cover members 93 each preferably have a rectangular or substantially rectangular shape corresponding to the lateral through-hole 92.

Figure 4:
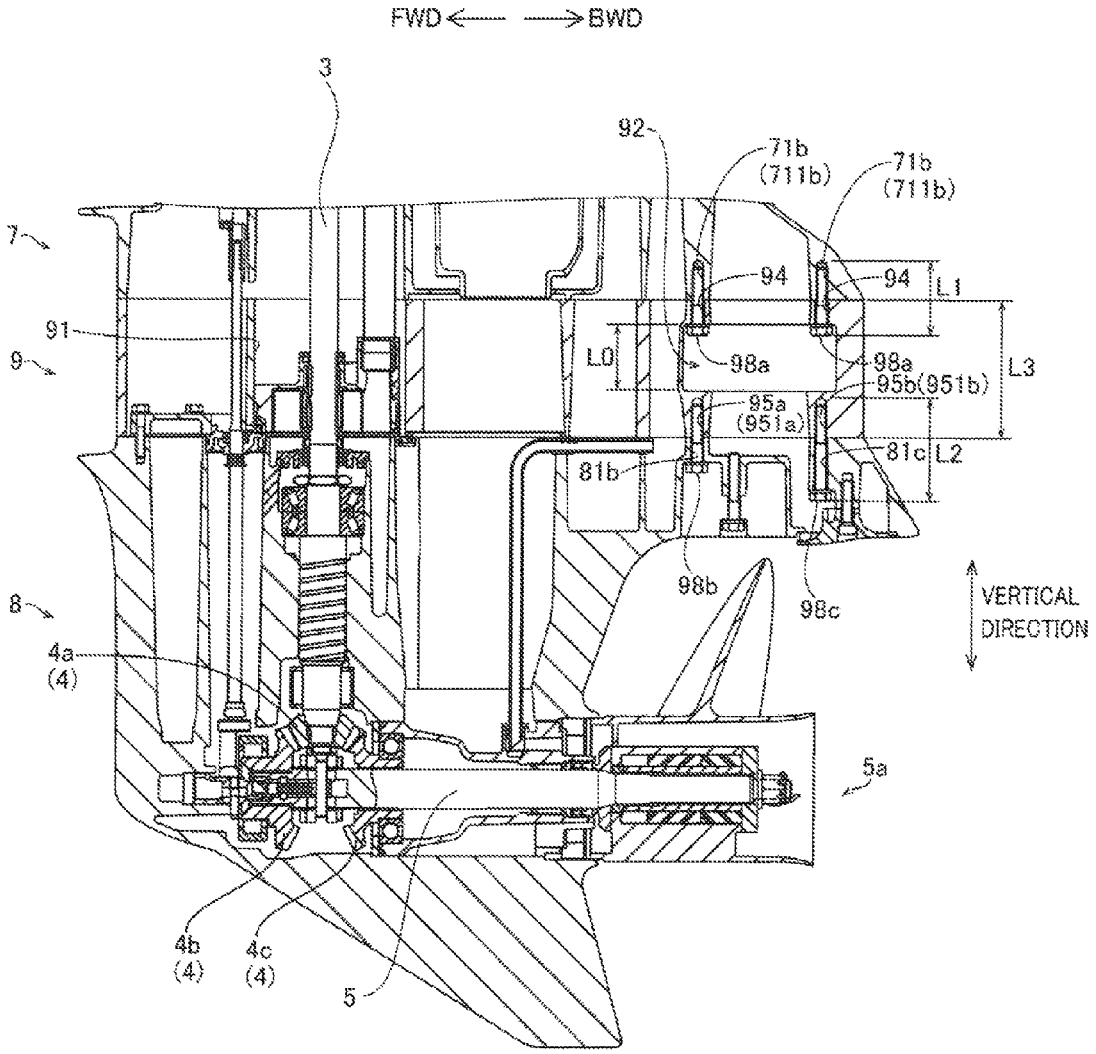
FIG. 4 is a sectional view showing a state where the spacer case is arranged in the outboard motor according to a preferred embodiment of the present invention.
Figure 5:
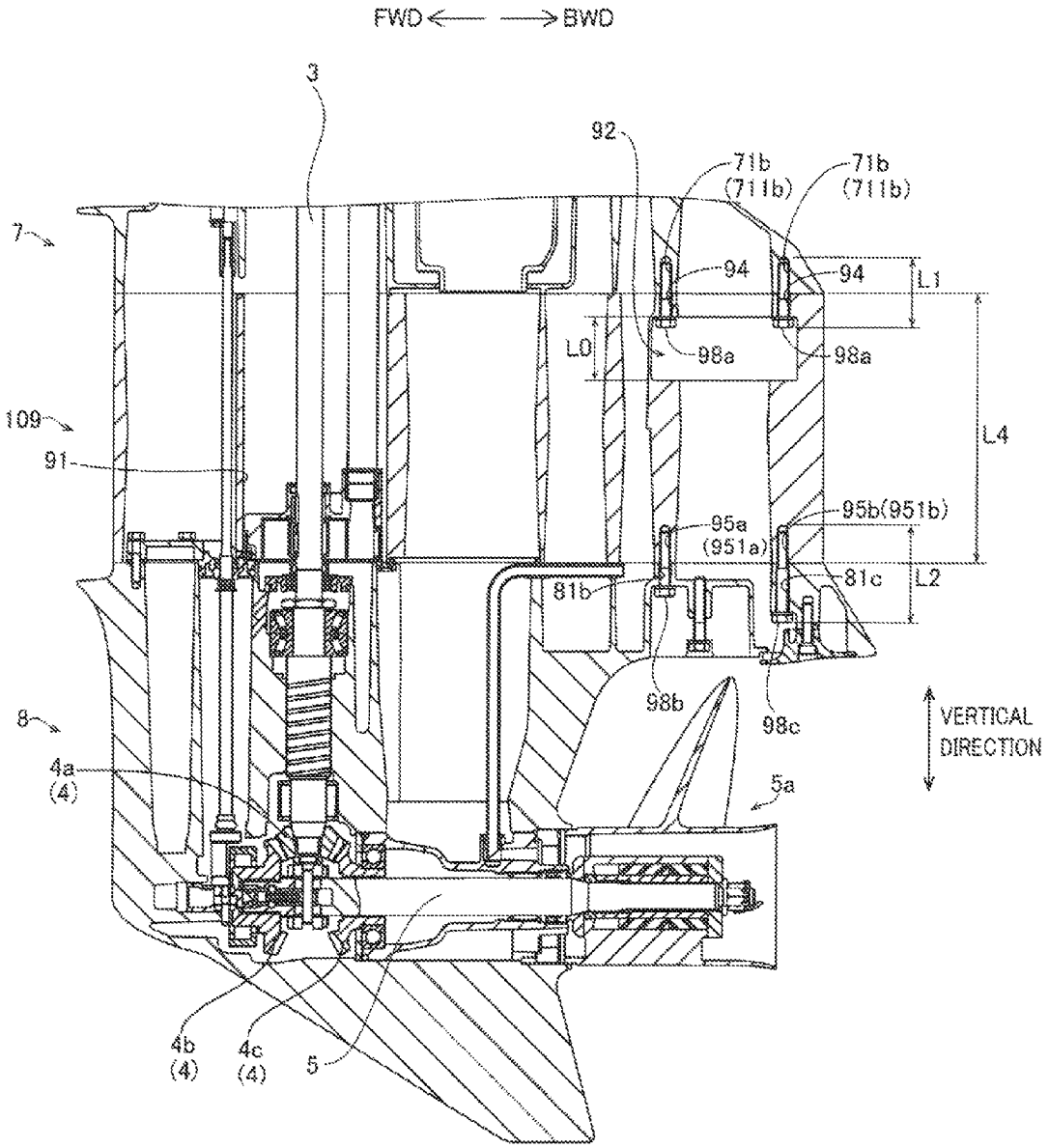
FIG. 5 is a sectional view showing a state where a spacer case longer than the spacer case shown in FIG. 4 is arranged in the outboard motor according to a preferred embodiment of the present invention.

The upper fastening holes 94 are provided at positions corresponding to the screw holes 71*b* of the upper case 7. The upper fastening holes 94 are configured to open to the upper surface 9*c* of the spacer case 9. As shown in FIGS. 4 and 5, the upper fastening holes 94 connect to the lateral through-hole 92 inside the spacer case 9. In other words, the upper fastening holes 94 are through-holes each having a cylindrical or substantially cylindrical shape extending in the vertical direction. No female screw holes are provided on the inner peripheral surfaces of the upper fastening holes 94. Two upper fastening holes 94 are provided at a prescribed interval along the anteroposterior direction. The upper fastening holes 94 are configured such that the bolts 98*a* are inserted thereinto.

As shown in FIG. 2, the lower fastening holes 95*a* and 95*b* are provided at positions corresponding to the screw insertion holes 81*b* and 81*c* of the lower case 8, respectively. As shown in FIGS. 3 to 5, the lower fastening hole 95*a* (95*b*) is configured to open to the lower surface 9*d* of the spacer case 9. The lower fastening hole 95*a* (95*b*) does not connect to the lateral through-hole 92. In other words, the lower fastening hole 95*a* (95*b*) is a non-through-hole opening only to the lower side. The lower fastening hole 95*a* (95*b*) extends in the vertical direction and has a cylindrical or substantially cylindrical shape. The inner peripheral surface of the lower fastening hole 95*a* (95*b*) includes a female screw hole 951*a* (951*b*). The lower fastening holes 95*a* and 95*b* are aligned along the anteroposterior direction. The lower fastening hole 95*a* (95*b*) is configured such that a bolt 98*b* (98*c*) is inserted thereinto.

The lower fastening holes 95*a* and 95*b* are provided at respective positions (the same position in the plan view) corresponding to the two upper fastening holes 94 in the vertical direction. In other words, the central axis lines of the lower fastening holes 95*a* and 95*b* and the central axis lines of the respective upper fastening holes 94 are arranged coaxially along the vertical direction. The lower fastening holes 95*a* and 95*b* are located in the vicinity (on the centerline 900 or in its vicinity) of a centerline 900 (see FIG. 2) of the spacer case 9 extending in the anteroposterior direction in the plan view.

As shown in FIG. 2, the lateral fastening holes 96 are provided at positions of the spacer case 9 corresponding to the screw holes 71*a* of the upper case 7. The lateral fastening holes 96 are through-holes each having a cylindrical or substantially cylindrical shape extending in the vertical direction. No female screw hole is provided on the inner peripheral surfaces of the lateral fastening holes 96. A plurality of lateral fastening holes 96 are arranged along the outer peripheral portion of the upper surface 9*c* of the spacer case 9. Recess portions 96*a* (see FIG. 3) are located at positions of the side surfaces 9*e* of the spacer case 9 corresponding to the lateral fastening holes 96, such that the bolts 98*a* are inserted into the lateral fastening holes 96.

The lateral fastening holes 97 are provided at positions in the lower end surface of the spacer case 9 corresponding to the screw insertion holes 81*a* of the lower case 8. The lateral fastening holes 97 are located at positions corresponding to the lateral fastening holes 96. The lateral fastening holes 97 are through-holes each having a cylindrical or substantially cylindrical shape extending in the vertical direction. The inner peripheral surfaces of the lateral fastening holes 97 include female screw holes 971. A plurality of lateral fastening holes 97 are provided along the outer peripheral portion of the lower surface 9*d* of the spacer case 9. The lateral fastening holes 97 are configured such that the bolts 98*b* are inserted thereinto.

As shown in FIG. 4, the bolts 98*a* to 98*c* each have a length not more than the length L3 of the spacer case 9 in the vertical direction. The bolts 98*a* and 98*b* each have a length not more than the length L0 of the lateral through-hole 92 in the vertical direction. The bolts 98*a* to 98*c* are bolts including male screw threads only on their tip ends. In other words, the bolts 98*a* to 98*c* are not studs including male screw threads on both ends. The bolts 98*a* and 98*b* have the same length L1. The bolt 98*c* has a length L2 larger than the length L1 of each of the bolts 98*a* (98*b*).

In the outboard motor 1, the spacer case 9 (length L3: see FIG. 4) or a spacer case 109 (length L4: see FIG. 5) having a different length in the vertical direction is arranged between the upper case 7 and the lower case 8, as shown in FIGS. 4 and 5, but the spacer cases 9 and 109 are fixed by the common bolts 98*a*, 98*b*, and 98*c*. The two spacer cases 9 and 109 having the different lengths are merely exemplary, and any of three or more spacer cases having different lengths may be arranged between the upper case 7 and the lower case 8. Also in this case, the three or more spacer cases may be fixed by the common bolts 98*a*, 98*b*, and 98*c*.

Figure 6:
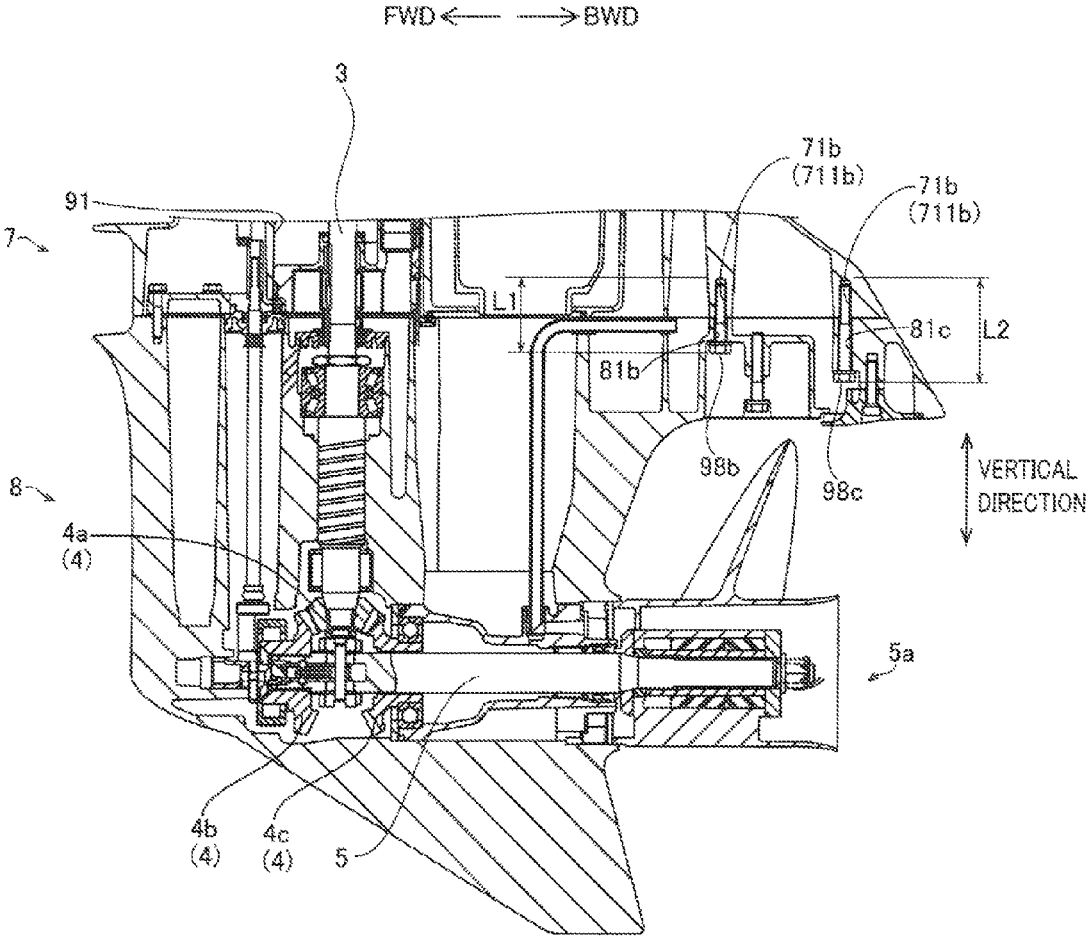
FIG. 6 is a sectional view showing a state where no spacer case is arranged in the outboard motor.

The outboard motor 1 is also configured such that the upper case 7 and the lower case 8 are directly fixed to each other without the spacer case 9 (see FIG. 4) or 109 (see FIG. 5), as shown in FIG. 6. Also in this case, the upper case 7 and the lower case 8 are fixed by the common bolts 98*b* and 98*c*. In this case, the bolts 98*b* inserted into the screw insertion holes 81*a* (see FIG. 2) of the lower case 8 are directly screwed into the screw holes 71*a* (see FIG. 2) of the upper case 7. Furthermore, the bolt 98*b* (98*c*) inserted into the screw insertion hole 81*b* (81*c*) of the lower case 8 is directly screwed into a screw hole 71*b* of the upper case 7. Thus, the position of the lower case 8 in the vertical direction with respect to the upper case 7 is easily adjusted.

A method for fixing the spacer case 9 and the lower case 8 is now described with reference to FIGS. 2 and 4.

First, the bolts 98*b* are inserted into the screw insertion holes 81*a* and 81*b* of the lower case 8 in a state where tip ends thereof are directed upward (toward the lateral through-hole 92), as shown in FIG. 2. The bolt 98*c* is inserted into the screw insertion hole 81*c* of the lower case 8 in a state where a tip end thereof is directed upward.

Then, the bolts 98*b* arranged at positions corresponding to the positions of the lateral fastening holes 97 of the spacer case 9 are screwed into the female screw holes 971 of the lateral fastening holes 97. The bolt 98*b* arranged at a position corresponding to the position of the lower fastening hole 95*a* of the spacer case 9 is screwed into the female screw hole 951*a* of the lower fastening hole 95*a*. The bolt 98*c* arranged at a position corresponding to the position of the lower fastening hole 95*b* of the spacer case 9 is screwed into the female screw hole 951*b* of the lower fastening hole 95*b*. Thus, the spacer case 9 and the lower case 8 are fixed to each other, as shown in FIG. 4.

A method for fixing the spacer case 9 and the upper case 7 is now described with reference to FIGS. 2, 4, and 7.

First, the bolts 98*a* are inserted into the lateral fastening holes 96 of the spacer case 9 in a state where tip ends thereof are directed upward, as shown in FIG. 2. The bolts 98*a* are inserted into the upper fastening holes 94 of the spacer case 9 in a state where tip ends thereof are directed upward.

Figure 7:
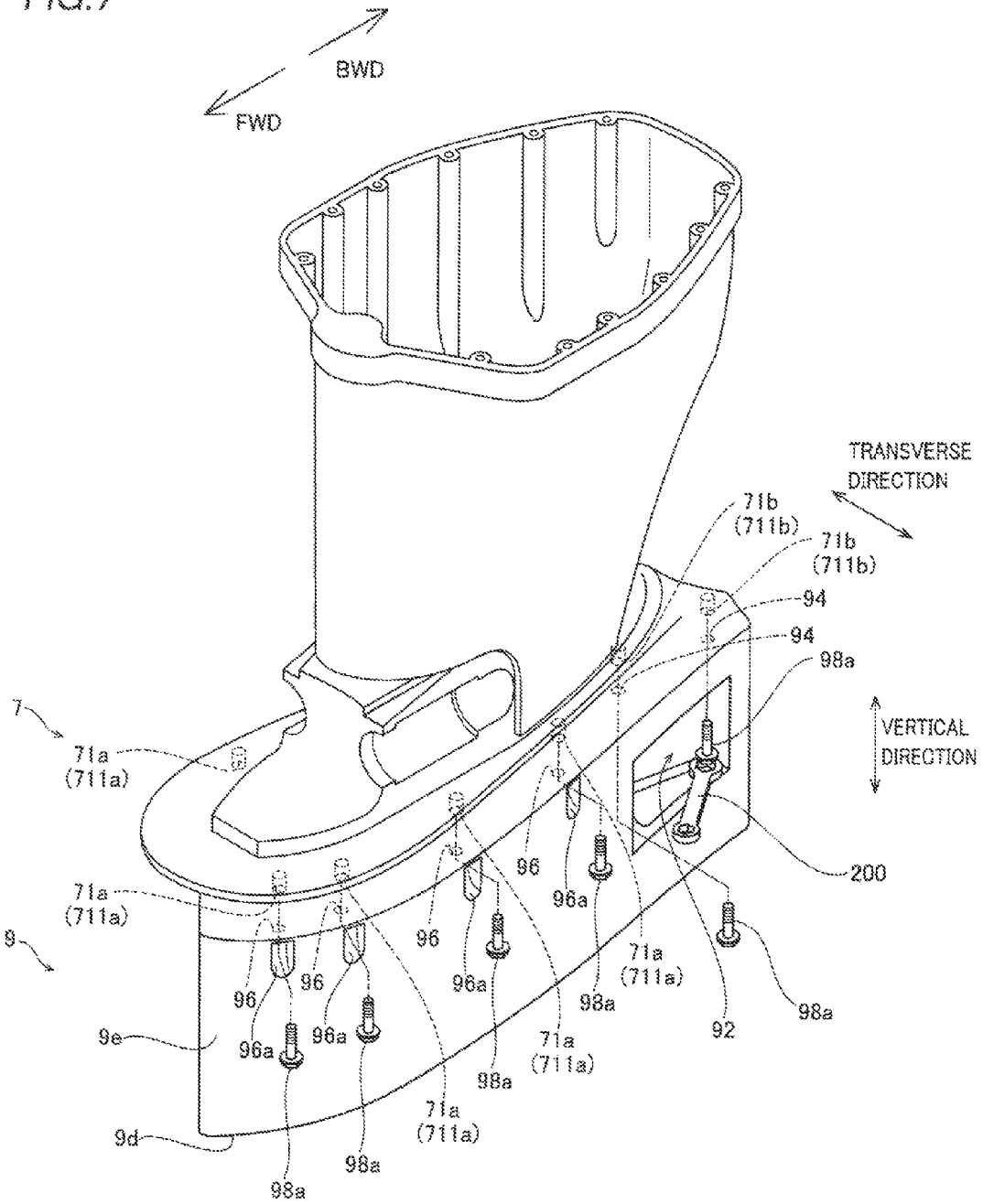
FIG. 7 is a diagram showing a state where a tool is inserted into a lateral through-hole to fasten a bolt in the outboard motor according to a preferred embodiment of the present invention.

Then, the bolts 98*a* arranged at positions corresponding to the positions of the lateral fastening holes 96 of the spacer case 9 are screwed into the female screw holes 711*a* of the screw holes 71*a* of the upper case 7 with a tool 200, as shown in FIG. 7. The bolts 98*a* arranged at positions corresponding to the positions of the upper fastening holes 94 of the spacer case 9 are screwed into the female screw holes 711*b* of the screw holes 71*b* of the upper case 7. Thus, the spacer case 9 and the upper case 7 are fixed to each other, as shown in FIG. 4. Thereafter, the cover members 93 are mounted on the lateral through-hole 92, as shown in FIG. 2.

According to the present preferred embodiment, the following effects are obtained.

According to the present preferred embodiment, as described above, the upper fastening holes 94 opening to the upper surface 9*c* of the spacer case 9, into which the bolts 98*a* are inserted and the lower fastening hole 95*a* (95*b*) opening to the lower surface 9*d* of the spacer case 9, into which the bolt 98*b* (98*c*) is inserted are provided in the rear portion 9*b*. Furthermore, the upper fastening holes 94 connect to the lateral through-hole 92 inside the spacer case 9. Thus, even in the case where the length between the upper case 7 and the lower case 8 is varied according to the mounting position of the upper case 7 on the boat body 100, the bolts 98*a* are inserted into the upper fastening holes 94 through the lateral through-hole 92 of the spacer case 9 to fix the spacer case 9. Consequently, the length of the upper fastening holes 94 connecting to the lateral through-hole 92 is kept constant even in the case where the spacer cases 9 and 109 having the different lengths are prepared, and hence no bolt 98*a* having a length according to the length of each of the spacer cases 9 and 109 is necessary. Thus, the length of the spacer case (9 or 109) can be varied without increasing the type of bolts 98*a*, and hence the outboard motor 1 according to the present preferred embodiment flexibly accommodates a difference in the length of the spacer case.

When the spacer case 9 is fixed to the upper case 7 and the lower case 8, the bolts 98*a* are inserted into the upper fastening holes 94 through the lateral through-hole 92 to fix the spacer case 9, and hence the spacer case 9 is fastened to the upper case 7 by the bolts 98*a* shorter than the spacer case 9. Thus, distortion of the bolts 98*a* is reduced or prevented. Therefore, a reduction in the fastening power of the bolts 98*a* is reduced or prevented, and the spacer case 9 is securely fixed to the upper case 7. Consequently, a reduction in the stiffness of all the cases of the outboard motor 1 is reduced or prevented even in the case where, in addition to the upper case 7 and the lower case 8, the spacer case 9 is provided. Thus, in the outboard motor 1 according to the present preferred embodiment, the reduction in the fastening power of the bolts 98*a* is reduced or prevented, and the spacer case 9 is securely fixed to the upper case 7 while the outboard motor 1 according to the present preferred embodiment flexibly accommodates a difference in the length (L3, L4) of the spacer case 9 in the vertical direction.

Furthermore, in the outboard motor 1 according to the present preferred embodiment, the spacer case 9 is fixed to the upper case 7 by the bolts 98*a* inserted into the upper fastening holes 94 through the lateral through-hole 92.

According to a preferred embodiment, the lateral through-hole 92 is configured to pass through the spacer case 9 laterally. Thus, the opening shape is bilaterally symmetrical.

According to a preferred embodiment, the lateral through-hole 92 is mounted with the cover members 93 covering the lateral through-hole 92. Thus, an increase in resistance between the spacer case 9 and external water is prevented. Furthermore, entry of extraneous material into the spacer case 9 through the lateral through-hole 92 is reduced or prevented.

According to a preferred embodiment, the female screw hole 951*a* (951*b*) is provided in the lower fastening hole 95*a* (95*b*). Thus, the bolt 98*b* (98*c*) inserted from the lower case 8 is easily fastened to the lower fastening hole 95*a* (95*b*) of the spacer case 9.

According to a preferred embodiment, no female screw hole is provided in the upper fastening holes 94, but the female screw hole 951*a* (951*b*) is provided in the lower fastening hole 95*a* (95*b*). Furthermore, the upper fastening holes 94 are configured to connect to the lateral through-hole 92, and the rear portion 9*b* is configured to be fastened to the upper case 7 by the bolts 98*a* inserted upward from the lateral through-hole 92 into the upper fastening holes 94 and to be fastened to the lower case 8 by screwing the bolt 98*b* (98*c*) inserted from the lower case 8 toward the lateral through-hole 92 into the female screw hole 951*a* (951*b*) of the lower fastening hole 95*a* (95*b*). Thus, the bolts 98*a* inserted from the lower side of the upper fastening holes 94, penetrating to the upper case 7 are easily fastened to the female screw holes 711*b* of the upper case 7, and the bolt 98*b* (98*c*) inserted from the lower side of the lower case 8 is easily fastened to the lower fastening hole 95*a* (95*b*).

According to a preferred embodiment, the lateral through-hole 92 is provided in the upper portions of the side surfaces 9*e* of the spacer case 9. Thus, the length of the bolts 98*a* inserted upward from the upper fastening holes 94 through the lateral through-hole 92 is further reduced.

According to a preferred embodiment, a plurality of upper fastening holes 94 and a plurality of lower fastening holes 95*a* and 95*b* are provided. Thus, the spacer case 9 is more reliably fixed to the upper case 7 and the lower case 8 by a plurality of bolts 98*a* and a plurality of bolts 98*b* and 98*c*.

According to a preferred embodiment, the upper fastening holes 94 are provided at the positions corresponding to the lower fastening holes 95*a* and 95*b* in the vertical direction. Thus, the screw holes 71*b* of the upper case 7, into which the bolts 98*a* inserted into the upper fastening holes 94 of the spacer case 9 are inserted, and the screw insertion holes 81*b* and 81*c* of the lower case 8, into which the bolts 98*b* and 98*c* inserted into the lower fastening holes 95*a* and 95*b* of the spacer case 9 are inserted, are arranged at positions corresponding to each other (the same positions in the plan view). Thus, even in the case where no spacer case 9 is arranged between the upper case 7 and the lower case 8, the upper case 7 and the lower case 8 are directly fixed to each other by the screw holes 71*b* of the upper case 7 and the screw insertion holes 81*b* and 81*c* of the lower case 8.

According to a preferred embodiment, the upper fastening holes 94 and the lower fastening hole 95*a* (95*b*) are provided in the vicinity of the centerline 900 of the spacer case 9 extending in the anteroposterior direction in the plan view. Thus, the spacer case 9 and the upper case 7 are fixed in a balanced manner in the vicinity of the centerline 900 of the spacer case 9 while the spacer case 9 and the lower case 8 are fixed in a balanced manner in the vicinity of the centerline 900 of the spacer case 9.

According to a preferred embodiment, the lateral through-hole 92 preferably has a rectangular or substantially rectangular shape. Thus, an insertion operation is more easily performed when the plurality of bolts 98*a* are inserted through the lateral through-hole 92 along the anteroposterior direction.

According to a preferred embodiment, the bolts 98*a* and the bolt 98*b* (98*c*) each have a length not more than the length L3 of the spacer case 9 in the vertical direction. Thus, the bolts

98*a* and the bolt 98*b* (98*c*) shorter than the spacer case 9 are used, such that distortion of the bolts 98*a* and the bolt 98*b* (98*c*) is reduced or prevented.

According to a preferred embodiment of the present invention, the bolts 98*a* each have the length L1 not more than the length L0 of the lateral through-hole 92 in the vertical direction. Thus, the bolts 98*a* are easily inserted into the upper fastening holes 94. Consequently, a fastening operation using the bolts 98*a* is easily performed.

The preferred embodiments disclosed above are to be considered as illustrative in all points and not restrictive. The range of the present invention is shown not by the above description of the preferred embodiments but by the scope of claims for patent, and all modifications within the meaning and range equivalent to the scope of claims for patent are further included.

For example, while the upper fastening holes 94 preferably connect to the lateral through-hole 92, which is an example of the lateral opening, in the above preferred embodiments, the present invention is not restricted to this. According to another preferred embodiment of the present invention, the lower fastening holes may alternatively connect to the lateral opening. In this case, the upper fastening holes include female screw holes. The first fastening members are inserted from the upper case (upper side) and are screwed into the female screw holes of the upper fastening holes to fix the spacer case. The lower fastening holes do not include female screw holes but connect to the lateral opening, and the second fastening members are inserted into the lower fastening holes through the lateral opening and are screwed into the female screw holes of the lower case located below. In this case, the lateral opening is preferably provided in a lower portion of the spacer case. Thus, the second fastening members that fix the spacer case to the lower case are reduced in length.

While the upper fastening holes 94 preferably connect to the lateral through-hole 92, which is an example of the lateral opening according the above preferred embodiments, the present invention is not restricted to this. According to another preferred embodiment of the present invention, both the upper fastening holes and the lower fastening holes may alternatively connect to the lateral opening.

Figure 8:
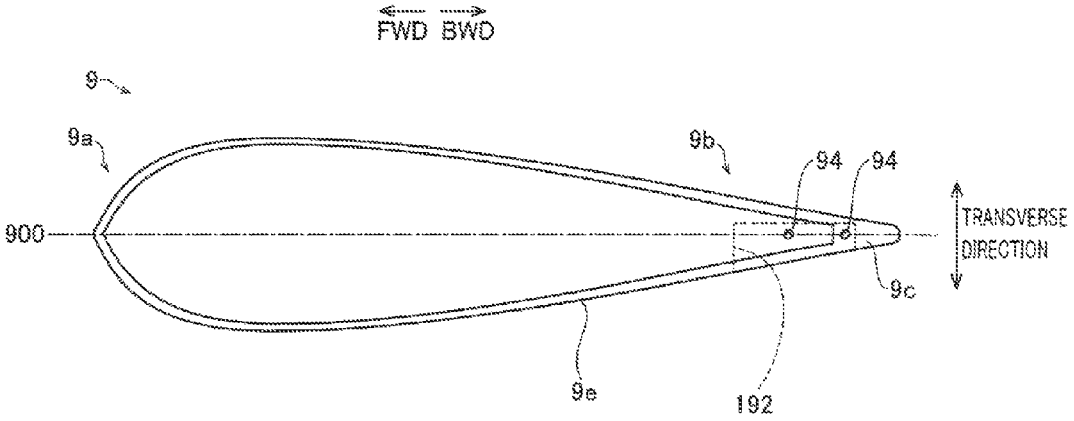
FIG. 8 is a plan view showing a modification of the spacer case of the outboard motor according to a preferred embodiment of the present invention.

While the lateral through-hole 92, which is an example of the lateral opening, preferably is provided in the spacer case 9 in the above preferred embodiments, the present invention is not restricted to this. According to another preferred embodiment of the present invention, a lateral recessed portion 192 (lateral opening) opening to one of the side surfaces 9*e* to be recessed may alternatively be provided in the spacer case 9, as shown in FIG. 8. In this case, it is preferable that the lateral recessed portion 192 is recessed beyond the centerline 900 from one of the side surfaces 9*e* of the spacer case 9 in the plan view. Thus, first fastening members 98*a* are easily inserted into the upper fastening holes 94 provided in the vicinity of the centerline 900 of the spacer case 9 extending in the anteroposterior direction in the plan view to fasten the spacer case 9.

While the cover members 93 preferably cover the lateral through-hole 92, which is an example of the lateral opening, in the above preferred embodiments, the present invention is not restricted to this. According to another preferred embodiment of the present invention, a cover member covering the lateral opening may not be provided.

While the two upper fastening holes 94 are preferably arranged along the anteroposterior direction and the two lower fastening holes 95*a* and 95*b* are preferably arranged along the anteroposterior direction in the above preferred embodiments, the present invention is not restricted to this. According to another preferred embodiment of the present invention, one upper fastening hole and one lower fastening hole may alternatively be arranged along the anteroposterior direction. Alternatively, three or more upper fastening holes and three or more lower fastening holes may be arranged along the anteroposterior direction.

While the bolts 98*b* and 98*c*, which are examples of the second fastening member, preferably have different lengths in the above preferred embodiments, the present invention is not restricted to this. According to another preferred embodiment of the present invention, all the second fastening members may alternatively have the same length. Thus, the number of different bolts to be used is reduced.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A spacer case for an outboard motor is arranged between an upper case and a lower case of the outboard motor and configured to adjust a position of the lower case in a vertical direction with respect to the upper case, the spacer case comprising:

a front portion including a drive shaft through-hole through which a drive shaft is configured to pass from an upper surface of the spacer case to a lower surface of the spacer case; and a rear portion including a lateral opening that opens to a side surface of the spacer case; wherein the rear portion includes:

an upper fastening hole opening to the upper surface of the spacer case and configured to receive a first fastening member; and a lower fastening hole opening to the lower surface of the spacer case and configured to receive a second fastening member; wherein at least one of the upper fastening hole and the lower fastening hole connects to the lateral opening inside the spacer case.

2. The spacer case for an outboard motor according to claim 1, wherein the lateral opening is a lateral through-hole passing laterally through the spacer case, or is a lateral recessed portion opening to the side surface of the spacer case.

3. The spacer case for an outboard motor according to claim 1, wherein the lateral opening includes a cover member covering the lateral opening.

4. The spacer case for an outboard motor according to claim 1, wherein one of the upper fastening hole and the lower fastening hole includes a female screw hole.

5. The spacer case for an outboard motor according to claim 4, wherein the female screw hole is not provided in the upper fastening hole and is provided in the lower fastening hole;

the upper fastening hole connects to the lateral opening; and the rear portion is fastened to the upper case by the first fastening member being inserted upward from the lateral opening into the upper fastening hole, and is fastened to the lower case by the second fastening member being inserted from the lower case toward the lateral opening into the female screw hole of the lower fastening hole.

6. The spacer case for an outboard motor according to claim 5, wherein the lateral opening is provided in an upper portion of the side surface of the spacer case.

7. The spacer case for an outboard motor according to claim 1, wherein the upper fastening hole includes a plurality of the upper fastening holes and the lower fastening hole includes a plurality of the lower fastening holes arranged along an anteroposterior direction of the spacer case.

8. The spacer case for an outboard motor according to claim 1, wherein the upper fastening hole is provided at a position corresponding to the lower fastening hole in the vertical direction.

9. The spacer case for an outboard motor according to claim 1, wherein the upper fastening hole and the lower fastening hole are provided in a vicinity of a centerline of the spacer case extending in an anteroposterior direction of the spacer case in a plan view.

10. The spacer case for an outboard motor according to claim 9, wherein the lateral opening is a lateral recessed portion recessed from the side surface toward the centerline of the spacer case; and the lateral recessed portion is recessed beyond the centerline in the plan view.

11. The spacer case for an outboard motor according to claim 1, wherein the lateral opening has a rectangular or substantially rectangular shape.

12. An outboard motor comprising:

an engine;

a drive shaft configured to be driven by the engine;

an upper case through which the drive shaft passes;

a lower case arranged below the upper case; and a spacer case arranged between the upper case and the lower case and configured to adjust a position of the lower case in a vertical direction with respect to the upper case; wherein the spacer case includes:

a front portion including a drive shaft through-hole through which the drive shaft passes from an upper surface of the spacer case to a lower surface of the spacer case; and a rear portion including a lateral opening that opens to a side surface of the spacer case;

the rear portion includes:

an upper fastening hole opening to the upper surface of the spacer case and configured to receive a first fastening member; and a lower fastening hole opening to the lower surface of the spacer case and configured to receive a second fastening member; wherein at least one of the upper fastening hole and the lower fastening hole connects to the lateral opening inside the spacer case.

13. The outboard motor according to claim 12, wherein the first fastening member and the second fastening member each have a length not more than a length of the spacer case in the vertical direction.

14. The outboard motor according to claim 13, wherein the length of at least one of the first fastening member and the second fastening member, being inserted into the upper fastening hole or the lower fastening hole through the lateral opening, is not more than a length of the lateral opening in the vertical direction.

15. The outboard motor according to claim 12, wherein the lateral opening includes a cover member covering the lateral opening.

16. The outboard motor according to claim 12, wherein one of the upper fastening hole and the lower fastening hole includes a female screw hole.

17. The outboard motor according to claim 16, wherein the female screw hole is not provided in the upper fastening hole and is provided in the lower fastening hole;

the upper fastening hole connects to the lateral opening; and the rear portion is fastened to the upper case by the first fastening member being inserted upward from the lateral opening into the upper fastening hole, and is fastened to the lower case by the second fastening member being inserted from the lower case toward the lateral opening into the female screw hole of the lower fastening hole.

18. The outboard motor according to claim 17, wherein the lateral opening is provided in an upper portion of the side surface of the spacer case.

19. The outboard motor according to claim 12, wherein the upper fastening hole includes a plurality of upper fastening holes and the lower fastening hole includes a plurality of lower fastening holes arranged along an anteroposterior direction.

20. The outboard motor according to claim 12, wherein the upper fastening hole is provided at a position corresponding to the lower fastening hole in the vertical direction.

* * * * *